US005864990A

United States Patent [19]

Tu

[11] Patent Number: 5,864,990

[45] Date of Patent: Feb. 2, 1999

[54] DRAIN BOARD FOR GUTTER

[76] Inventor: Yu-Pin Tu, No. 101, Wen-Hua S Rd., Pu-Tzu City, Chia-I Hsien, Taiwan

[21] Appl. No.: 907,776

[22] Filed: Aug. 11, 1997

[51] Int. Cl.[6] ..... E04D 13/035

[52] U.S. Cl. ..... 52/19; 52/660; 52/12; 49/381; 210/163; 404/25; 404/26

[58] Field of Search ..... 52/11, 12, 660, 52/19–20, 69, 799.1; 404/2–5, 25, 26; 210/163, 164; 405/52, 80, 118; 49/381; 16/221, 229, 254, 255, 256, 260–262

[56] References Cited

U.S. PATENT DOCUMENTS

| | | | |
|---|---|---|---|
| 3,501,874 | 3/1970 | Hahne | 52/19 |
| 3,896,595 | 7/1975 | Anghinetti | 52/19 |
| 4,594,157 | 6/1986 | McGowan | 404/4 X |
| 5,017,039 | 5/1991 | Spiess | 52/19 |
| 5,032,264 | 7/1991 | Geiger | 404/4 X |
| 5,146,718 | 9/1992 | Baskett | 52/11 |
| 5,160,213 | 11/1992 | Spiess | 52/19 X |
| 5,274,965 | 1/1994 | Jackson | 52/11 |
| 5,284,580 | 2/1994 | Shyh | 52/12 X |
| 5,324,135 | 6/1994 | Smith | 404/25 |
| 5,451,119 | 9/1995 | Hondulas | 52/20 X |
| 5,507,590 | 4/1996 | Argandona | 52/20 X |
| 5,586,837 | 12/1996 | Udelle | 52/12 X |
| 5,640,810 | 6/1997 | Pietersen | 52/12 |
| 5,727,351 | 3/1998 | Neathery | 52/20 |

*Primary Examiner*—Carl D. Friedman
*Assistant Examiner*—Beth Aubrey
*Attorney, Agent, or Firm*—Browdy and Neimark

[57] ABSTRACT

An improved drain board for use on a gutter particularly has a cover board pivotally secured to a mounting bracket. The cover board has an outwardly extended pivot pole at one corner thereof and an inwardly extended receiving tube at the opposite corner for accommodation of a bias spring and a movable pivot rod. At the corresponding corners of the mounting bracket is disposed an outwardly extended engaging tube respectively so as to permit the fixed pivot pole and the movable pivot rod of the cover borad to be pivotally mounted onto the mounting bracket and the cover board is well protected from being stolen with ease by burglars.

1 Claim, 4 Drawing Sheets

DRAIN BOARD FOR GUTTER

BACKGROUND OF THE INVENTION

The present invention relates to an improved drain board for use on a gutter, and more particular to one having a cover board pivotally secured to a mounting bracket. The cover board has an outwardly extended pivot pole at one corner thereof and an inwardly extended receiving tube at the opposite corner for accommodation of a bias spring and a movable pivot rod. At the corresponding corners of the mounting bracket is disposed an outwardly extended receiving tube respectively so as to permit the fixed pivot pole and the movable pivot rod of the cover board to be pivotally mounted onto the mounting bracket.

In modern cities, underground sewage systems have been indispensably adopted to handle massive household, commercial and common waste water, preventing enviromental pollution from getting worse in urban areas. Such sewage systems are commonly connected to gutters along both sides of roads or streets so as to drain water coming mostly from rain. To prevent gutters from getting stuck with waste articles after long period of use, they have to be maintained routinely. So, a drain board must be placed at proper sections of gutters. As shown in FIGS. 1, 1A, the prior art drain board assembly is made up of a mounting bracket 5 and a cover board 6 that are locked together by a chain 51 to prevent the cover boards 6 from being stolen by burglars.

Such a conventional drain board has the following disadvantages:

1. one end of the chain must be fixed to the inner wall of a gutter by means of a driller and an expansion screw, it is tedious and labor wasting to perform such task;
2. the chain can be easily broken by a burglar to take away the cover board;
3. the stealing of such cover boards makes the gutters full of trapping holes, people and vehicles can be fatally hurt by accident;
4. such cover boards are flatly placed on the ground when removed for cleaning maintenance of gutters without any warning signs.

SUMMARY OF THE INVENTION

The primary object of the present invention is to provide an improved drain board structure having a pivotal cover board and a mounting bracket. At one corner of the cover board is disposed a fixed pivot pole and at the opposite corner is disposed an inwardly extended receiving tube in which a bias spring and a movable pivot rod are housed. At the corresponding corners of the drain bracket is disposed an external engaging tube respectively for housing the fixed pivot pole and the movable pivot rod respectively so that the cover board can be pivotally erected in routine maintenance.

Another object of the present invention is to provide an improved drain board wherein the cover board and the mounting bracket of the drain board are locked together so that the cover board can not be stolen with ease.

One further object of the present invention is to provide an improved drain board having a pivotal cover board which can be clearly seen when erected in the routine maintenance of a gutter as a warning sign.

One still further object of the present invention is to provide an improved drain board having a cover board which can be easily mounted onto a mounting bracket in assembly but is difficult to be dismantled by a burglar.

BRIEF DESCRIPTION OF THE DRAWINGS

FIGS. 1, 1A are diagrams showing the structure of a conventional drain board assembly, wherein FIG. 1A is an enlarged view of circled area 1A in FIG. 1;

DETAILED DESCRIPTION OF THE PREFERRED EMBODIMENT

Figure 1:
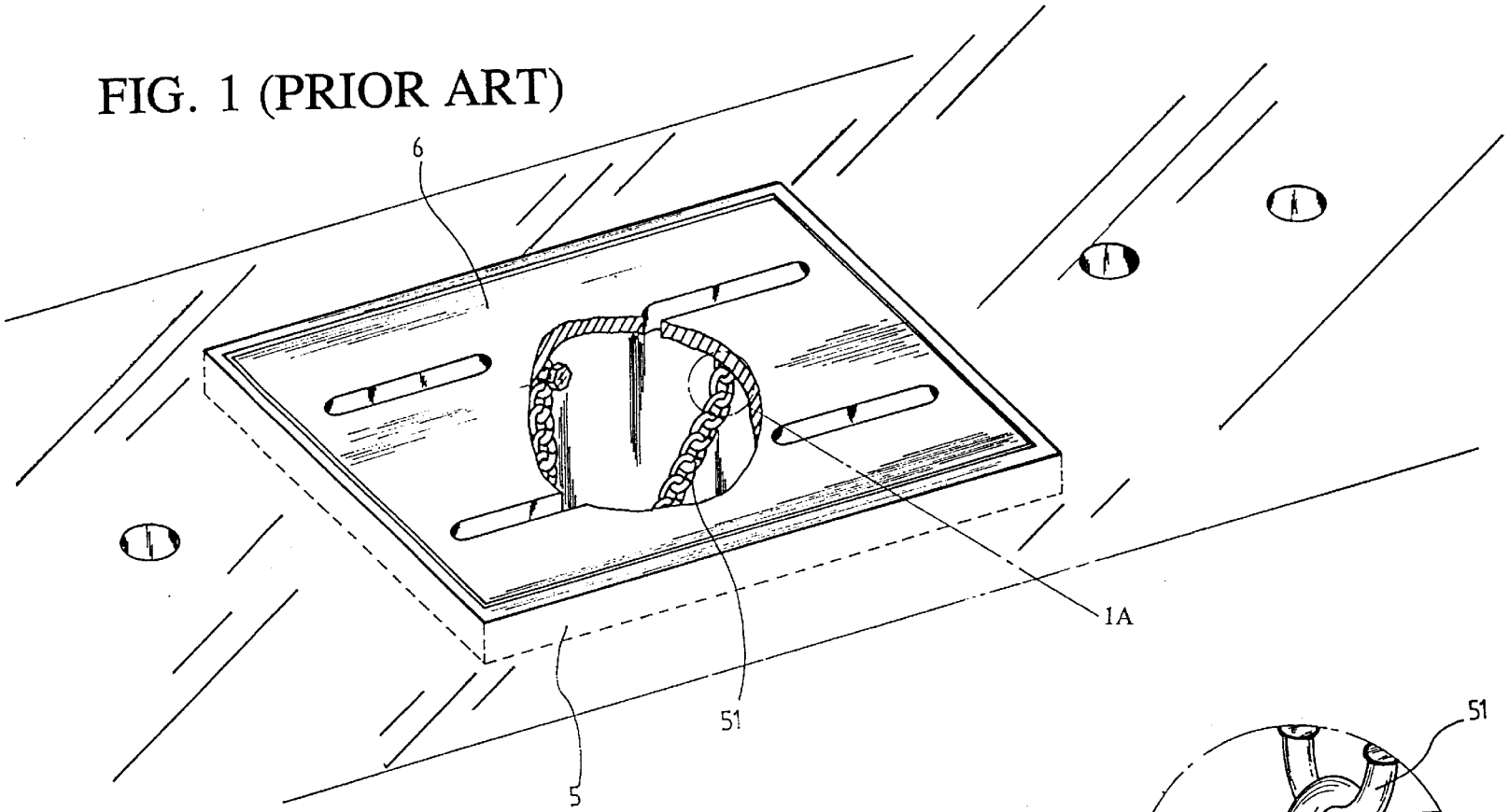
FIG. 1 (PRIOR ART)
Figure 1A:
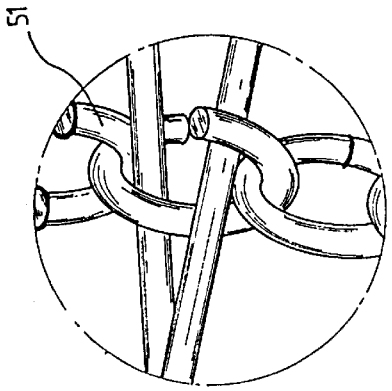
Figure 2:
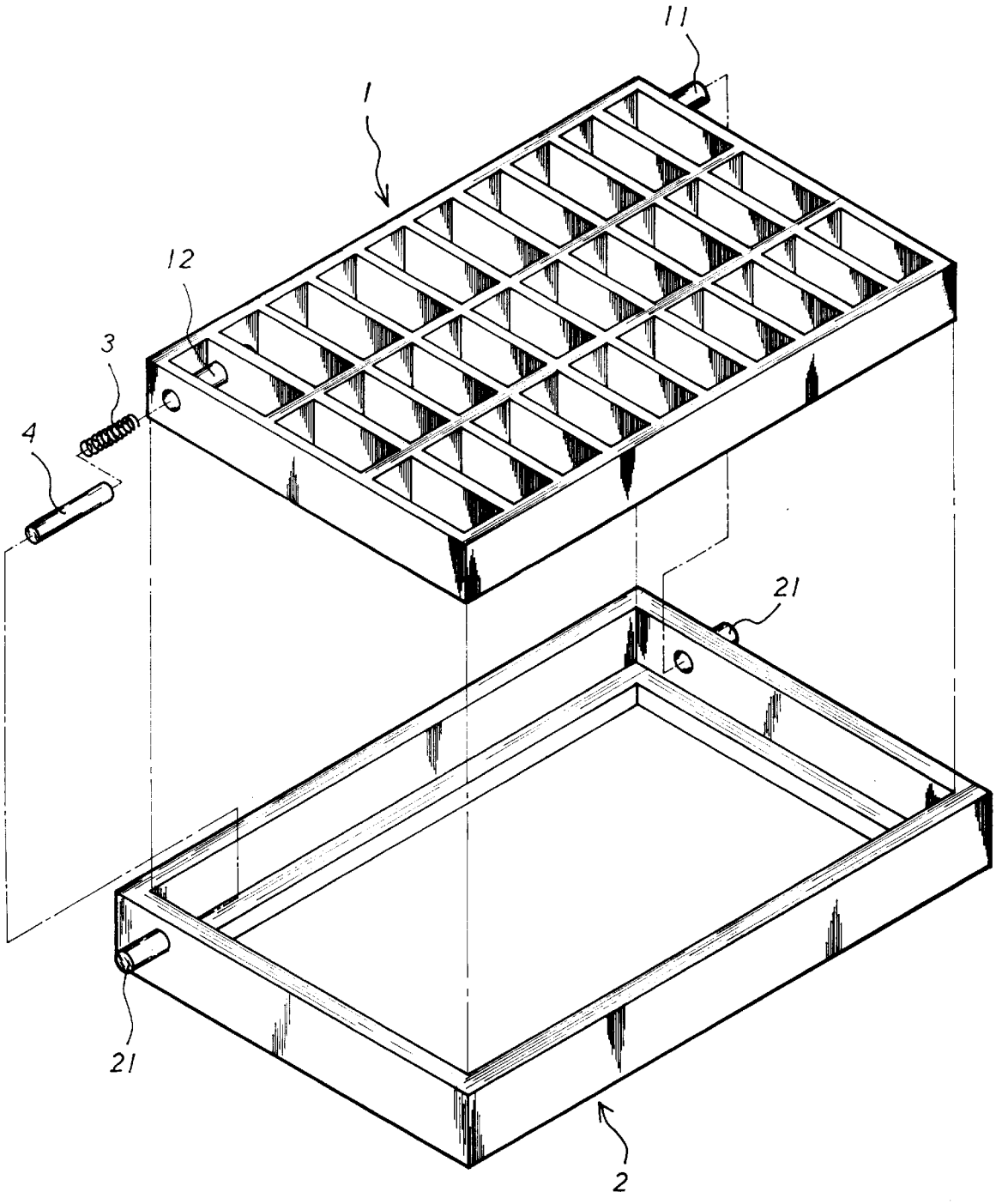
FIG. 2 is a diagram showing the exploded components of the present invention.
Figure 3:
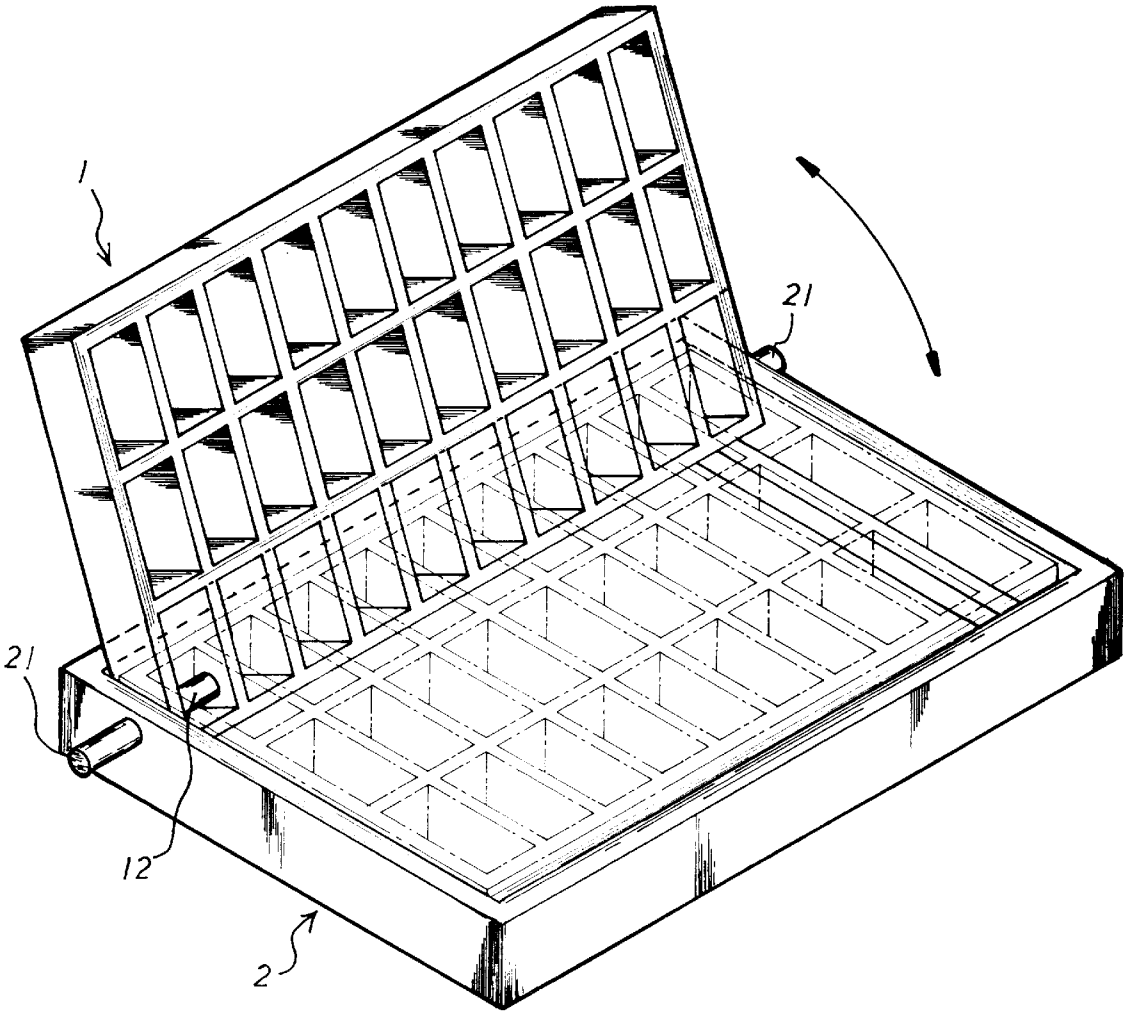
FIG. 3 is a diagram showing the cover board being pivoted at an angle.
Figure 4:
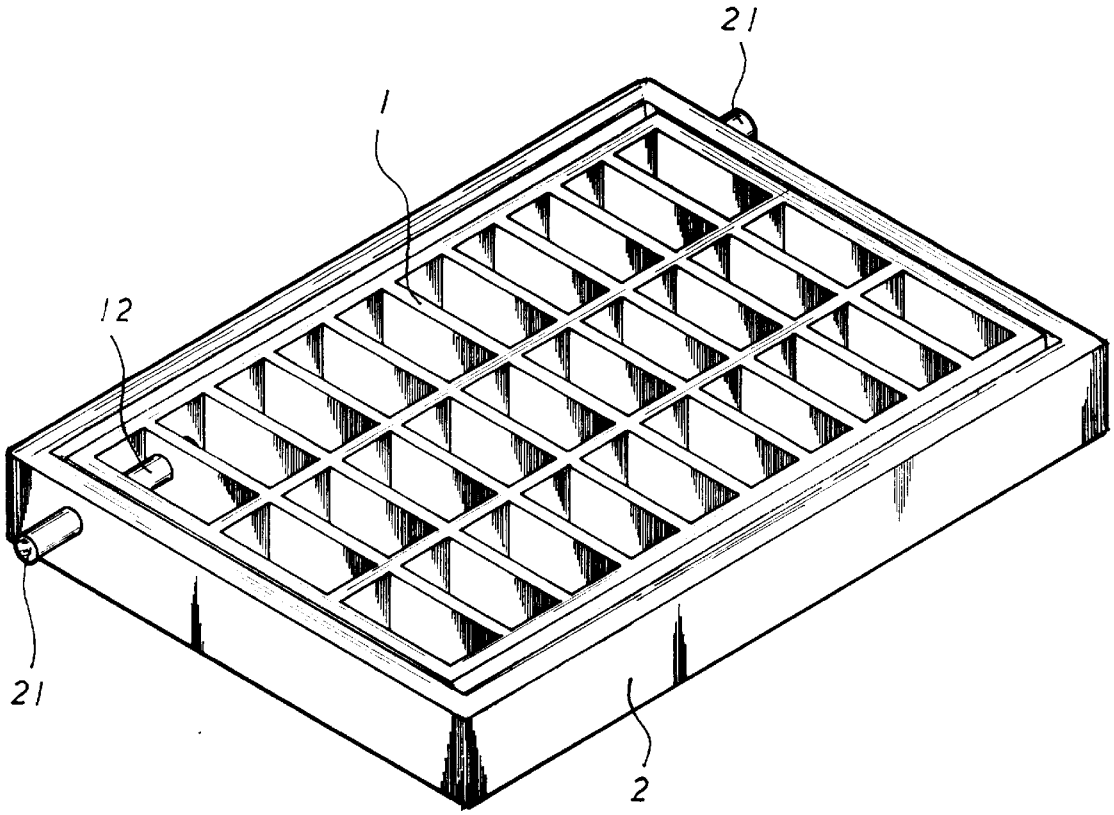
FIG. 4 is a diagram showing the assembly of the drain board of the present invention in practical use.

Referring to FIGS. 2, 3, 4, the improved drain board assembly of the present invention for use on a gutter is comprised of a cover board 1, a mounting bracket 2, a bias spring 3, and a movable pivot rod 4.

The cover board 1 has a latticed structure for drainage purpose and is equipped with a fixed pivot pole 11 outwardly extending from one corner and a receiving tube 12 inwardly extending at an opposite corner thereof. The receiving tube 12 is closed at one end.

The mounting bracket 2 has an engaging tube 21 disposed at each corner thereof in correspondence to the outwardly extended fixed pivot pole 11 and the movable pivot rod 4 housed in the receiving tube 12 of the latticed cover board 1. The movable pivot rod 4 is slightly longer than the receiving tube 12 of the cover board 1.

In practical use, the mounting bracket 2 is first engaged to the top of a gutter by concrete and molding boards, and the molding boards are removed after the mounting bracket 2 becomes solidified into shape. Afterwards, the cover board 1 is pivotally secured to the mounting bracket 2 by first housing the bias spring 3 and the movable pivot rod 4 in the receiving tube 12 of the cover board 1 and then engaging the fixed pivot pole 11 of the cover board 1 in one of the engaging tubes 21 of the mounting bracket 2 with the movable pivot rod 4 pressed by hand and being aligned with the other engaging tube 21, resulting in the engaging of the pivot rod 4 with the engaging tube 21 after the removal of the hand of the pressed pivot rod due to the urge of the bias spring 3. The pivot rod 4 is longer than the receiving tube 12 so that the pivot rod 4 can be surely retained in place between the engaging tube 21 and the receiving tube 12, permitting the cover board 1 to be pivotally retained in place without being easily dismantled by a burglar.

Referring to FIG. 3, the cover board 1 can be pivoted upwardly in a specific angle but the cover board 1 is hard to removed because the pivot rod 4 urged by the bias spring 3 is fixed between the engaging tube 21 and the receiving tube 12 to make the cover board 1 burglar proof.

I claim:

1. An improved drain board for use on a gutter, comprising a cover board, a mounting bracket, a bias spring and a movable pivot rod wherein:

said cover board having a latticed structure to permit drainage and a fixed pivot pole extending outwardly from one corner and a receiving tube extending inwardly at an opposite corner thereof; said receiving tube having a closed end; said receiving tube having a first end of the bias spring engaged therein against the closed end and the movable pivot rod also engaged therein against a second end of the bias spring;

said mounting bracket having two engaging tubes respectively disposed at each corner thereof respectively corresponding to said outwardly extended fixed pivot pole and said movable pivot rod housed in said receiving tube of said latticed cover board;

whereby said cover board is pivotally secured to said mounting bracket by engaging said fixed pivot pole of said cover board in a first of said engaging tubes of said mounting bracket and engaging said movable pivot rod with a second of said engaging tubes by first compressing said movable pivot rod into said receiving tube and then releasing said movable pivot rod into said second of said engaging tubes.

* * * * *